United States Patent [19]

Denzin et al.

[11] Patent Number: 4,850,580

[45] Date of Patent: Jul. 25, 1989

[54] SEPARATING HEAD

[75] Inventors: Horst Denzin; Heinz Rehberg, both of Berlin, Fed. Rep. of Germany

[73] Assignee: Francotyp-Postalia GmbH, Berlin, Fed. Rep. of Germany

[21] Appl. No.: 158,573

[22] Filed: Feb. 22, 1988

[51] Int. Cl.[4] ..... B65H 5/02

[52] U.S. Cl. ..... 271/2; 271/10; 271/110; 271/119; 271/121; 414/797.7; 156/441.5

[58] Field of Search ..... 271/2, 121, 124, 125, 271/10, 119, 121; 414/129, 797.7; 156/571, 441.5

[56] References Cited

U.S. PATENT DOCUMENTS 2,726,862 12/1955 Anderson ..... 271/124

4,718,809 1/1988 Krasuski ..... 271/121 X

*Primary Examiner*—Richard A. Schacher

*Attorney, Agent, or Firm*—Herbert L. Lerner; Laurence A. Greenberg

[57] ABSTRACT

An automatic feed device for postal franking machines includes a feed tray, a device for transporting mail on the feed tray and a drive of the transporting device. A separating head in the form of a structural unit includes brake levers separating mail and pressure rollers, holding-down devices and a manual actuating lever transporting mail. Guide shafts support the separating head during displacement of the separating head into a housing from an operating position outside the housing. A detent shaft and a slide lock the separating head in the operating position. A microswitch coupled with the slide controls the drive of the transporting device.

11 Claims, 5 Drawing Sheets

SEPARATING HEAD

The invention relates to a separating head for an automatic feed device of a postal franking machine, which combines brake levers serving as separating means, and pressure rollers, holding-down devices and a manual actuating lever serving as transporting means, into a structural unit.

Automatic feed devices are disposed at the inlet of postal franking machines, in order to set up automatic mail handling lines. These feed devices can be adjusted to process 8,000 to 12,000 letters per hour, for example, and their task is to individually feed the letters from a stack to the franking machine that follows. To this end, the feed devices are equipped with a separating head. The separating head is disposed above the feed tray. The separating head includes driven transporting means in the form of an eccentric and transport wheels. The eccentric has a rubber tread on part of the periphery thereof which grips the letter contacting it and pushes it to the transport wheels. Brake levers which serve as separating means that face the eccentric in the separating head have a friction lining constructed in such a way that the eccentric overlaps the brake levers by a slight extent in the intervening spaces. The task of the brake levers serving as separating means is to retain the other letters so that only one letter at a time can be withdrawn from a stack. The pressure rollers of the separating head are located in such a way as to face the transport wheels of the feed table. The brake levers and the pressure rollers of the separating head are resiliently supported, so that the letters may have a variable thickness, within predetermined limits. If the thickness of a letter exceeds the predetermined limit, then it is no longer possible for it to pass through the automatic feed device. In that case, the feed device has to be removed, which is labor-intensive and hence uneconomical.

It is accordingly an object of the invention to provide a separating head, which overcomes the hereinaforementioned disadvantages of the heretofore-known devices of this general type and which is constructed in such a way that it can be removed from the vicinity of the feed tray for accommodating thicker letters, so that such letters can be manually fed to the franking machine that follows, without having to remove the entire feed device.

With the foregoing and other objects in view there is provided, in accordance with the invention, an automatic feed device for postal franking machines, comprising a feed tray; means for transporting mail on the feed tray; a drive of the transporting means; a housing; a separating head in the form of a structural unit including brake levers separating mail, and pressure rollers, holding-down devices and a manual actuating lever transporting mail; guide shafts supporting the separating head during displacement of the separating head into the housing from an operating position outside the housing; a detent shaft and a slide locking the separating head in the operating position; and a microswitch coupled with the slide for controlling the drive of the transporting means.

In accordance with another feature of the invention, there are provided guide shafts, two runners disposed on the guide shafts, a traverse running on the runners, and a bearing bracket of the separating head mounted on the traverse.

In accordance with a further feature of the invention, there is provided a rotary rod unlocking the separating head, simultaneously raising the the brake levers, the pressure rollers, the slide and the manual operating member and pivoting the holding-down device.

In accordance with an added feature of the invention, there is provided a primary shaft unlocking and locking the separating head by rotation thereof, a rocker disposed on the primary shaft and acting upon the manual operating member, the slide, the brake levers and the pressure rollers, and a gear wheel mechanism disposed on the primary shaft and acting upon the holding-down device.

In accordance with an additional feature of the invention, the holding-down device is pivoted into the housing for displacement of the separating head upon unlocking the separating head.

In accordance with yet another feature of the invention, one of the runners has a U-shaped recess formed therein in which the slide is guided.

In accordance with yet a further feature of the ivention, the detent shaft has a recess formed therein, and the slide snaps into place in the recess in the operating position.

In accordance with yet an added feature of the invention, there is provided a rotary rod unlocking the separating head, the slide continuously actuating the microswitch by locking the rotary knob.

In accordance with a concomitant feature of the invention, there is provided a gear wheel mechanism through which the rotary knob acts upon the primary shaft for lessening forces exerted upon unlocking.

Other features which are considered as characteristic for the invention are set forth in the appended claims.

Although the invention is illustrated and described herein as embodied in a separating head, it is nevertheless not intended to be limited to the details shown, since various modifications and structural changes may be made therein without departing from the spirit of the invention and within the scope and range of equivalents of the claims.

The construction and method of operating of the invention, however, together with additional objects and advantages thereof will be best understood from the following description of specific embodiments when read in connection with the accompanying drawings.

Figure 1:
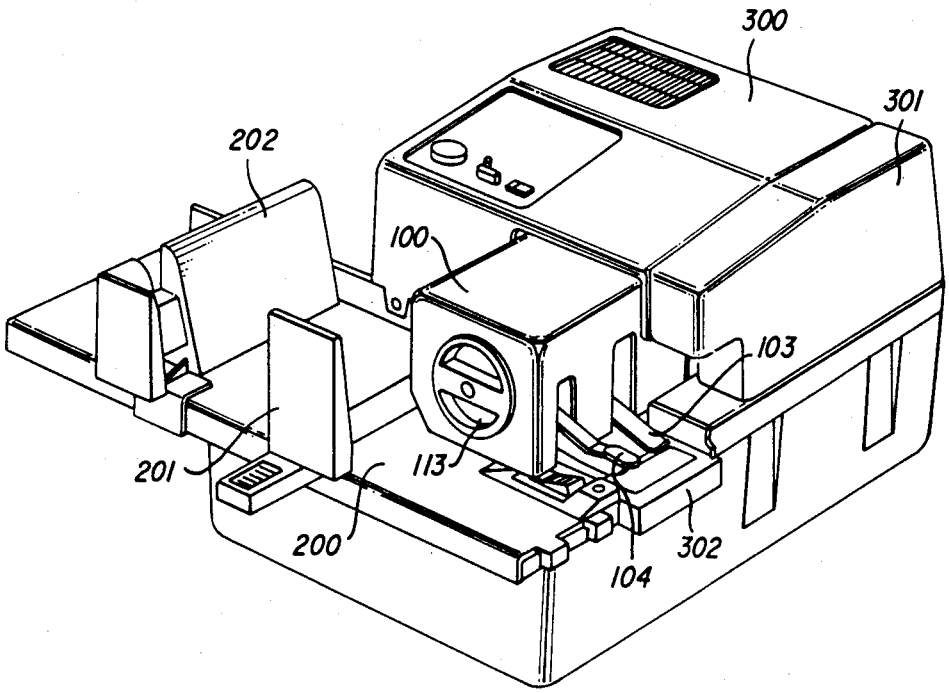
FIG. 1 is a diagrammatic, perspective view of an automatic feed device.
Figure 2:
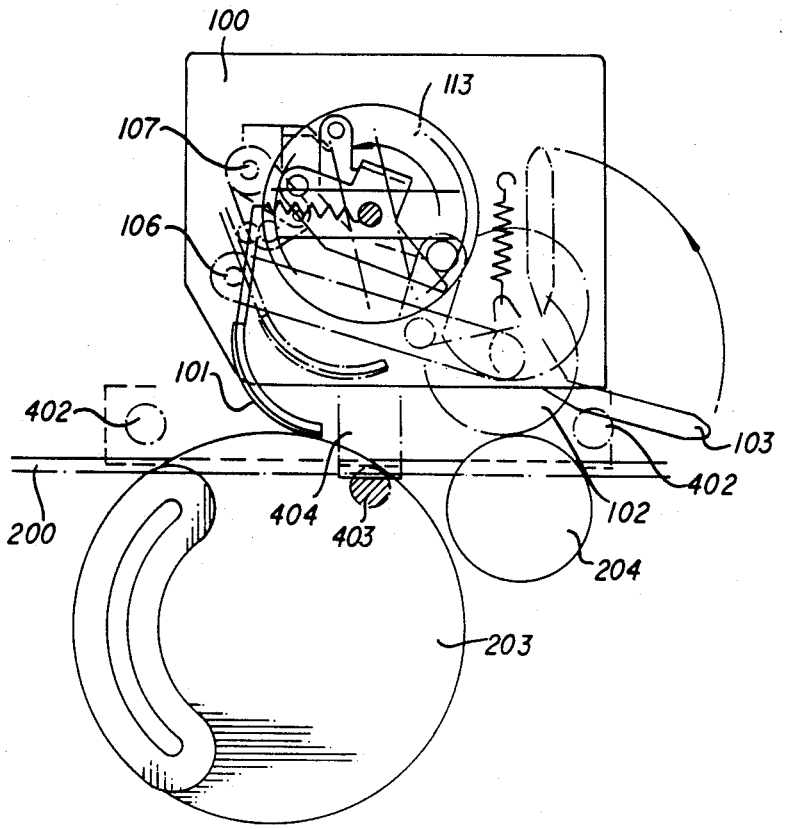
FIG. 2 is a fragmentary, front-elevational view of a separating head with a diagrammatically illustrated feed tray as well as eccentric and transport rollers.
Figure 3:
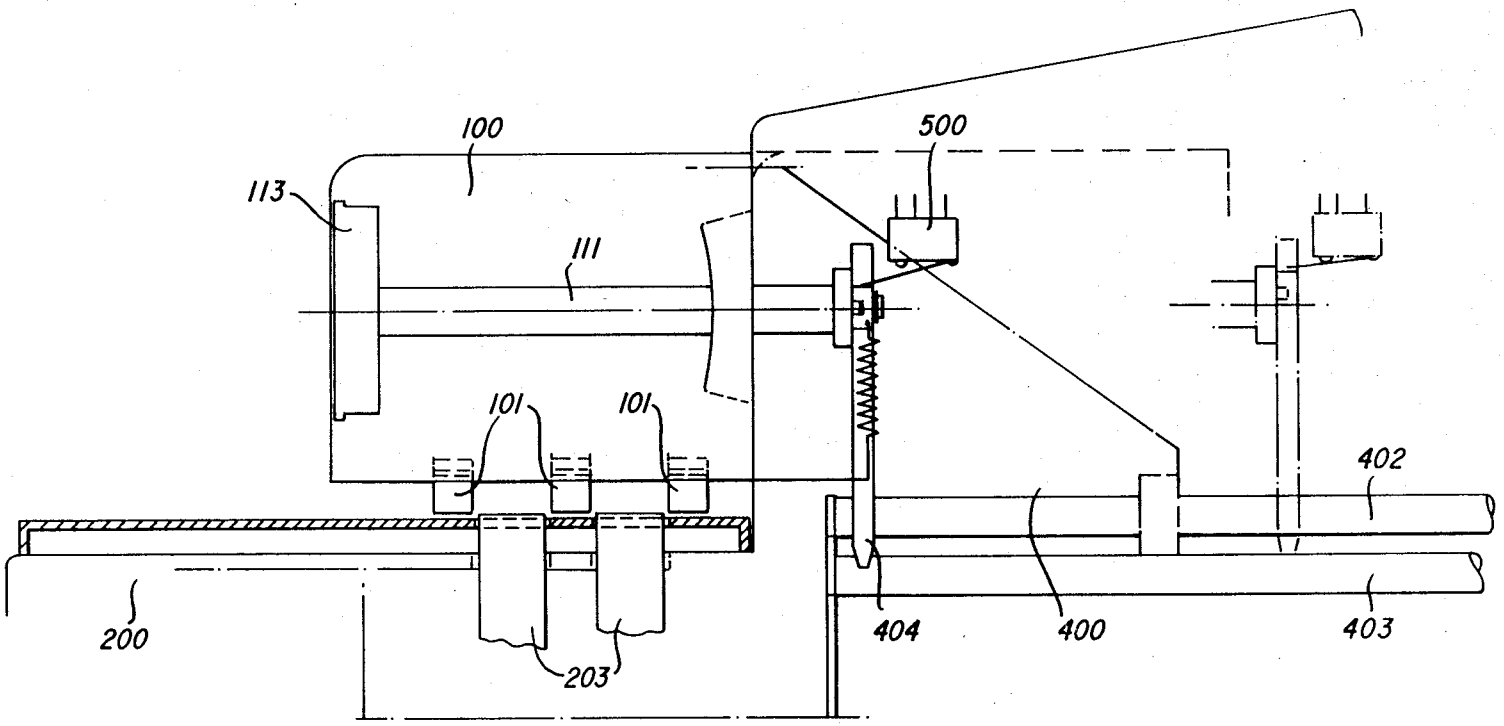
FIG. 3 is a fragmentary, side-elevational view of the separating head.

Referring now in detail to the figures of the drawings in which identical elements and versions thereof have the same reference numerals and first, particularly, to FIGS. 1–3 thereof, there is seen an automatic feed device which is formed of a feed tray, table or chute 200 having adjustable chute-type sides 201, 202 capable of being folded down for adaptation to various sizes of letters. The letters are withdrawn individually from the chute by means of an eccentric 203, with a separating head 100 being used for separation. To this end, the separating head 100 is disposed above the feed tray 200 on a feed housing 300, which contains operating and control means. A water container 301 for a moistening device 302 which moistens gummed edges of the envelopes is mounted on the feed tray 200 flush with the housing 300. The sides of the water container 301 oriented toward the separating head 100 and toward the feed tray 200 are constructed in such a way that there is a gap between the housing 300, the water container 301 and the feed tray 200.

The feed housing 300 is dimensioned in such a way that it can receive the separating head 100 therein. This means that before thicker letters are manually put in place, the separating head 100 is pushed into the housing 300. To this end, the functional elements protruding out of the separating head 100 must be pivoted out of the way.

Protruding out of the separating head 100 are three brake levers 101, two pressure rollers 102, a holding-down device 103 and a manual operating member 104. The brake levers 101 serve to retain the letters. The pressure rollers 102 serve to transport the letters in combination with the driven transprot wheels 204 of the feed tray 200. The holding-down device 103 presses the letters onto the moistening device 302 disposed downstream thereof. On one hand, the manual operating member 104 serves the same purpose as the holding-down device 103 and on the other hand it serves to manually raise the brake levers 101, the pressure rollers 102 and the holding-down device 103 in the event of malfunctions.

Figure 4:
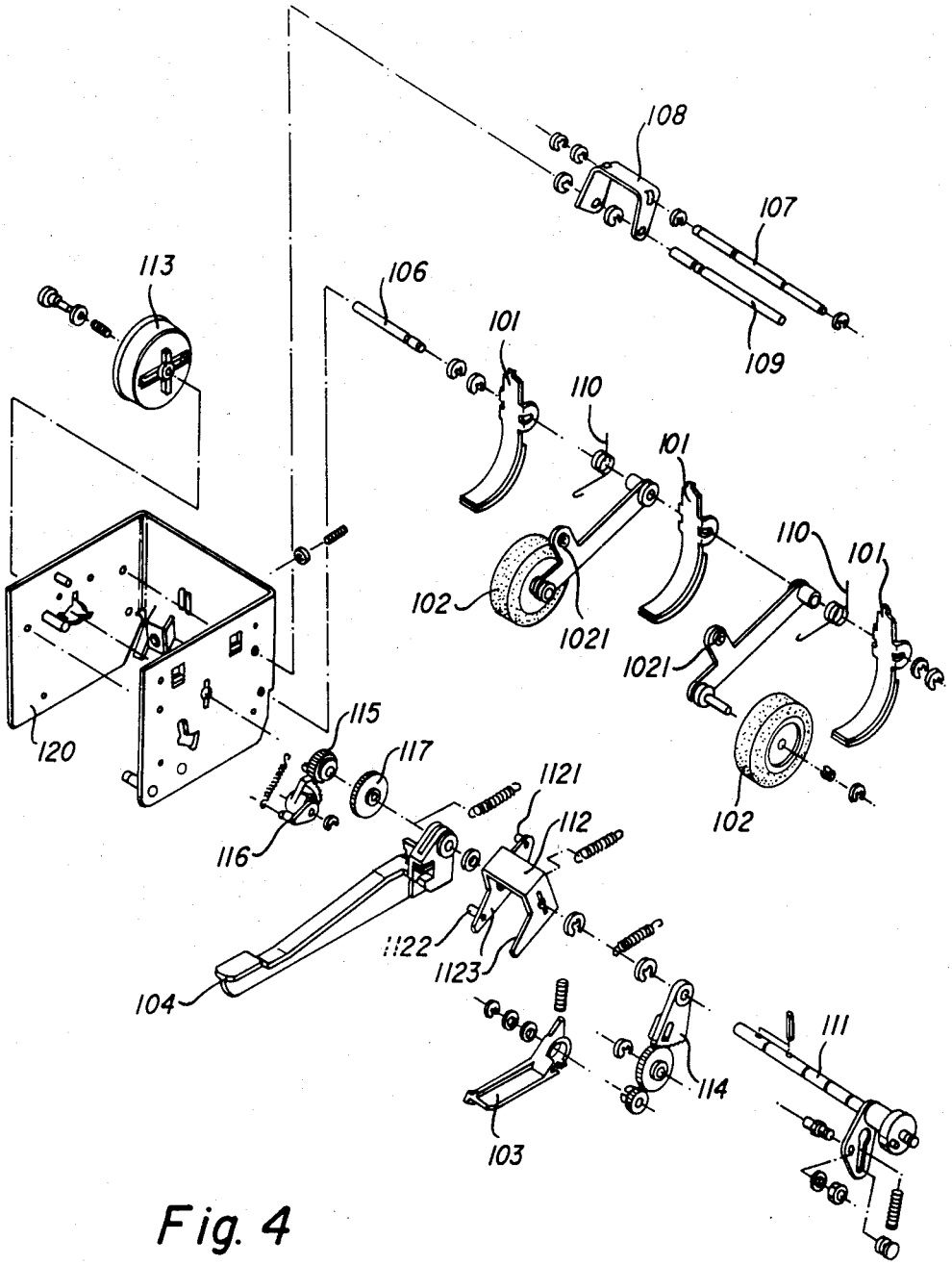
FIG. 4 is an exploded perspective view of the separating head.

The brake levers 101 and the pressure rollers 102 are pivotably disposed on a common bearing shaft 106 of a bearing bracket 120 of the separating head 100, shown in FIGS. 2 and 4. A further shaft 107 bears a rocker bracket 108, with a pivot bar 109. The pivot bar 109 rests against the brake levers 101. The bearing shaft 106 acts as a journal for torsion springs 110.

A rocker 112 is secured on a primary shaft 111 of the bearing bracket 120 and an upper protrusion 1121 of the rocker 112 rests on one leg of the rocker bracket 108. A lower protrusion 1122 engages a recess in the manual operating member 104. Arms 1123 rest beneath pins 1021. Actuation of a rotary knob 113 pivots the primary shaft 111, thus raising the brake levers 101, the pressure rollers 102 and the manual operating member 104. The brake levers 101 and the pressure rollers 102 are pivoted into the bearing bracket 120, while the manual operating member 104 is raised.

A gear wheel mechanism 114 is provided in the form of a toothed quadrant, pinion and spur wheel in order to also pivot the holding-down device 103 into the bearing bracket 120 at the same time that the rotary knob 113 is actuated. This gear wheel mechanism 114 pivots the holding-down device 103 into a vertical position inside the bearing bracket 120.

Figure 5:
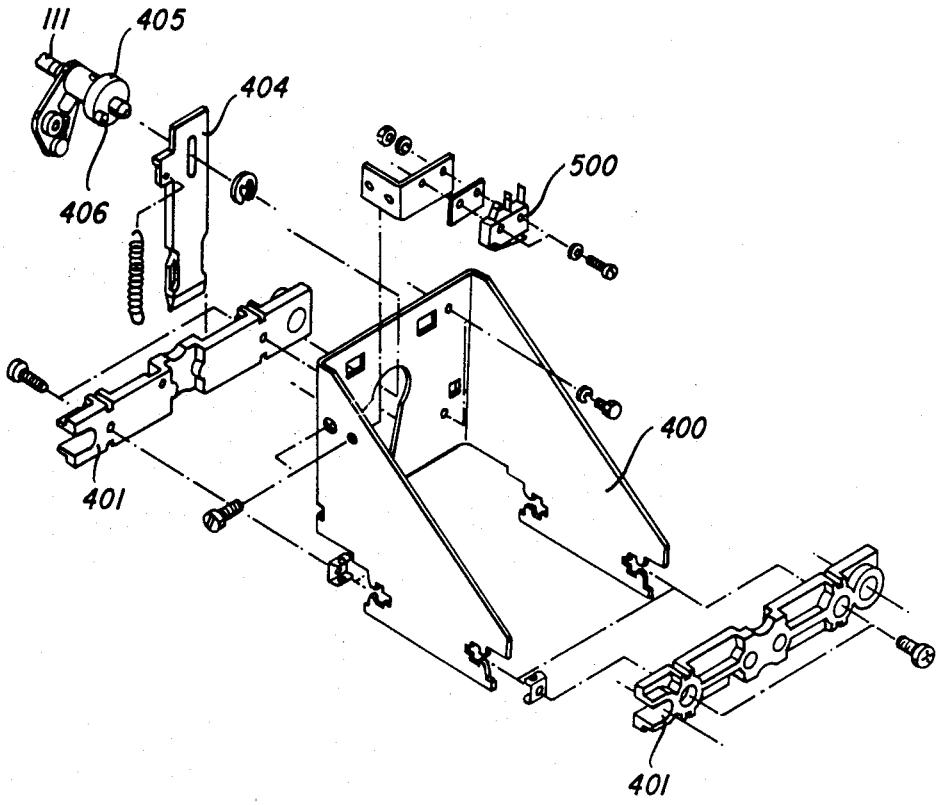
FIG. 5 is an exploded perspective view of a traverse of the separating head and of various elements in FIGS. 3 and 4, withonly those that are relevant to the invention being identified by reference numerals in FIG. 5.

In order to displace the separating head 100 from an operating position outside the housing to a retracted position within the housing 300 of the feed device, the bearing bracket 120 is mounted on a traverse 400 seen in FIGS. 3 and 5. The traverse 400 is provided with two runners 401, which run on parallel guide shafts 402. A further detent shaft 403 serves to fix the separating head 100 in the operating position, that is in the pulled-out state thereof. To this end, a slide 404 is mounted upon the end of the primary shaft 111 and is guided in a U-shaped recess of one of the runners 401. In the operating position of the separating head 100, the slide 404 latches into a recess of the detent shaft 403. Upon actuation of the rotary knob 113, a cylindrical pin 406 on a driver 405 moves the slide 404 out of the detent position against a spring force. This raising of the slide 404 is utilized for controlling a microswitch 500, which switches off the drive of the eccentric 203 and the transport wheels 204. The slide 404 is raised by the cylindrical pin 406 upon displacement of the separating head 100 into the housing 300 and thus the microswitch interrupts the drive through the slide 404 until the separating head 100 returns to the operating position thereof and is locked by re-latching of the slide 404.

In the inserted state of the separating head 100, the end of the manual operating member 104 that has only been raised and protrudes out of the separating head rests in the gap between the water container 301, the housing 300 and the feed tray 200.

In order to lessen the force exerted when the rotary knob 113 is actuated, the knob is not directly operatively connected with the primary shaft 111. The rotary knob 113 is mounted on the primary shaft 111 and moves a toothed quadrant 116 through a gear wheel 115. The toothed quadrant then in turn pivots the primary shaft 111 thorugh a spur wheel 117.

We claim:

1. Automatic feed device for postal franking machines, comprising a feed tray; means for transporting mail on said feed tray; a housing adjacent said feed tray; means disposed in said housing for driving said transporting means; a separating head in the form of a structural unit displaceable between an operating position above said feed tray outside said housing and a retracted position within said housing, said separating head including brake levers for retaining mail on said feed tray, pressure rollers for transporting mail in cooperation with said transporting means, a holding-down device and a manual actuating lever for pressing down mail; guide shafts supporting said separating head during displacement of said separating head into said retracted position in said housing from said operating position outside said housing; a detent shaft and a slide locking said separating head in said operating position; and a microswitch coupled with said slide for controlling said drive means.

2. Automatic feed device according to claim 1, including guide shafts, two runners disposed on said guide shafts, a traverse running on said runners, and a bearing bracket of said separating head mounted on said traverse.

3. Automatic feed device according to claim 1, including a rotary rod unlocking said separating head, simultaneously raising said said brake levers, said pressure rollers, said slide and said manual operating member and pivoting said holding-down device.

4. Automatic feed device according to claim 3, including a primary shaft unlocking and locking said separating head by rotation thereof, a rocker disposed on said primary shaft and acting upon said manual operating member, said slide, said brake levers and said pressure rollers, and a gear wheel mechanism disposed on said primary shaft and acting upon said holding-down device.

5. Automatic feed device according to claim 4, wherein said holding-down device is pivoted into said housing for displacement of said separating head upon unlocking said separating head.

6. Automatic feed device according to claim 2, wherein one of said runners has a U-shaped recess formed therein in which said slide is guided.

7. Automatic feed device according to claim 6, wherein said detent shaft has a recess formed therein, and said slide snaps into place in said recess in said operating position.

8. Automatic feed device according to claim 7, including a rotary rod unlocking said separating head, said slide continuously actuating said microswitch by locking said rotary knob.

9. Automatic feed device according to claim 4, including a gear wheel mechanism through which said rotary knob acts upon said primary shaft for lessening forces exerted upon unlocking.

10. Automatic feed device according to claim 1, including means for unlocking said slide and permitting said separating head to be displaced into said retracted position.

11. Automatic feed device according to claim 1, including a water container disposed on said feed tray adjacent said housing, and a moistening device associated with said water container and disposed below said holding-down device for moistening mail.

* * * * *